US010705468B2

(12) United States Patent
Matsuo et al.

(10) Patent No.: US 10,705,468 B2
(45) Date of Patent: Jul. 7, 2020

(54) IMAGE FORMING APPARATUS, IMAGE FORMING SYSTEM, CONTROL METHOD FOR IMAGE FORMING APPARATUS, AND PROGRAM

(71) Applicant: Konica Minolta, Inc., Chiyoda-ku, Tokyo (JP)

(72) Inventors: Masahiro Matsuo, Kokubunji (JP); Makoto Ui, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/177,861

(22) Filed: Nov. 1, 2018

(65) Prior Publication Data

US 2019/0179247 A1 Jun. 13, 2019

(30) Foreign Application Priority Data

Dec. 13, 2017 (JP) ..... 2017-238354

(51) Int. Cl.
*G03G 15/00* (2006.01)
*G03G 15/20* (2006.01)

(52) U.S. Cl.
CPC ..... *G03G 15/602* (2013.01); *G03G 15/2053* (2013.01)

(58) Field of Classification Search
None
See application file for complete search history.

(56) References Cited

U.S. PATENT DOCUMENTS 5,159,356 A * 10/1992 Sogu ..... G03G 15/0142 101/487
7,085,526 B2 * 8/2006 Tanimoto ..... G03G 15/167 399/313
8,147,023 B2 * 4/2012 Hatada ..... B41J 11/001 347/101
8,208,833 B2 * 6/2012 Kitagawa ..... G03G 15/2035 399/122
8,469,477 B2 * 6/2013 Hiroike ..... B41J 11/42 347/16
2002/0080225 A1 * 6/2002 Taki ..... B41J 2/32 347/223

(Continued)

FOREIGN PATENT DOCUMENTS

JP 2007-041370 A 2/2007
JP 2018060135 A * 4/2018

*Primary Examiner* — Ted W Barnes
(74) *Attorney, Agent, or Firm* — Squire Patton Boggs (US) LLP

(57) ABSTRACT

An image forming apparatus includes: a conveyer that conveys continuous paper; an image creator that outputs an image onto the continuous paper, a heat source that imparts heat to the continuous paper; and a hardware processor that controls a printing action for forming an image on the continuous paper conveyed in a forward direction by the conveyer, using the image creator and the heat source, wherein when interrupting the printing action, the hardware processor performs withdrawal control in which the continuous paper is conveyed in a reverse direction such that a final image formed on the continuous paper before interruption of the printing action reaches a withdrawal position defined upstream of the heat source in the forward direction.

15 Claims, 6 Drawing Sheets

(56) References Cited

U.S. PATENT DOCUMENTS

| | | | | |
|---|---|---|---|---|
| 2005/0022936 | A1* | 2/2005 | Sender | B32B 38/14 156/384 |
| 2007/0215039 | A1* | 9/2007 | Edwards | H01M 4/8626 118/46 |
| 2011/0261131 | A1* | 10/2011 | Eve | B41J 11/002 347/104 |
| 2015/0078771 | A1* | 3/2015 | Tanigami | G03G 15/6529 399/45 |
| 2015/0241821 | A1* | 8/2015 | Fukai | G03G 15/6564 399/70 |
| 2015/0277334 | A1* | 10/2015 | Matsuo | G03G 15/70 399/21 |
| 2015/0316878 | A1* | 11/2015 | Ishizuka | G03G 15/6594 399/68 |
| 2016/0124358 | A1* | 5/2016 | Yamaguchi | G03G 15/2032 399/68 |
| 2016/0202648 | A1* | 7/2016 | Takada | G03G 15/2032 399/67 |
| 2016/0313681 | A1* | 10/2016 | Matsuo | G03G 15/2039 |
| 2017/0060048 | A1* | 3/2017 | Sasami | G03G 15/2028 |
| 2017/0068196 | A1* | 3/2017 | Ujike | G03G 15/0189 |
| 2017/0075282 | A1* | 3/2017 | Higashimura | G03G 15/6582 |
| 2017/0097595 | A1* | 4/2017 | Yamada | G03G 15/2014 |
| 2017/0308012 | A1* | 10/2017 | Kibayashi | G03G 15/2032 |
| 2018/0292770 | A1* | 10/2018 | Yamaura | G03G 15/1615 |

* cited by examiner

IMAGE FORMING APPARATUS, IMAGE FORMING SYSTEM, CONTROL METHOD FOR IMAGE FORMING APPARATUS, AND PROGRAM

The entire disclosure of Japanese patent Application No. 2017-238354, filed on Dec. 13, 2017, is incorporated herein by reference in its entirety.

BACKGROUND

Technological Field

The present invention relates to an image forming apparatus, an image forming system, a control method for the image forming apparatus, and a program.

Description of the Related Art

Conventionally, an image forming apparatus and an image forming system including the image forming apparatus are known. As the image forming apparatus, an image forming apparatus using an electrophotographic process is known and an image is formed on a sheet through a series of processes of transferring (outputting) the image onto the sheet and fixing the transferred image on the sheet. A fixing device that performs a fixing process includes a pair of fixing members that form a fixing nip by being pressed against each other and fixes an image by heat and pressure.

This type of image forming apparatus can use not only a sheet of a specified size but also a long sheet (hereinafter referred to as "continuous paper") such as roll paper or faun paper. Meanwhile, in the image forming apparatus, it is necessary to interrupt the printing action in response to the occurrence of an interruption event such as out of toner, full of waste toner, and carrying out image correction. Daring the interruption of the printing action, the conveyance of the continuous paper is temporarily stopped.

For example, JP 2007-41370 A discloses an approach of reciprocating the continuous paper on a conveying path while an image is not being formed on the continuous paper in order to suppress the defamation staying on the continuous paper. According to the technology disclosed in JP 2007-41370 A, since the situation in which the continuous paper is kept stationary with respect to a specific component of the image forming apparatus is suppressed, the occurrence of damage to the continuous paper can be suppressed.

However, in the technology disclosed in JP 2007-41370 A, while the printing action is interrupted, an area (blank area) of the continuous paper on the upstream side of the final image formed before the interruption of the printing action continues to be present around the fixing device in some cases. In this case, moisture is released from the blank area by receiving heat from the fixing device and the size of the continuous paper is reduced. Meanwhile, when the printing action is resumed, an image is formed on the blank area reduced in size. After the image formation, however, the continuous paper absorbs moisture from the ambient atmosphere to return to the original size and accordingly, there is a possibility that the magnification of the image alters in line with this phenomenon.

Even in a case where the reciprocating action is not performed, the same phenomenon occurs in conditions where the blank area is present around the fixing device while the printing action is interrupted.

In addition, such a phenomenon is not only caused by the fixing heat of the image forming apparatus using the electrophotographic process, but also is a problem similarly occurring in an image forming apparatus using a technique in which heat is applied to the continuous paper as the image is formed.

SUMMARY

The present invention has been made in view of the above circumstances and an object of the present invention is to suppress a change in image magnification before and after interruption of a printing action in printing on continuous paper.

To achieve the abovementioned object, according to an aspect of the present invention, an image forming apparatus reflecting one aspect of the present invention comprises: a conveyer that conveys continuous paper; an image creator that outputs an image onto the continuous paper, a heat source that imparts heat to the continuous paper; and a hardware processor that controls a printing action for forming an image on the continuous paper conveyed in a forward direction by the conveyer, using the image creator and the heat source, wherein when interrupting the printing action, the hardware processor performs withdrawal control in which the continuous paper is conveyed in a reverse direction such that a final image formed on the continuous paper before interruption of the printing action witches a withdrawal position defined upstream of the heat source in the forward direction.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
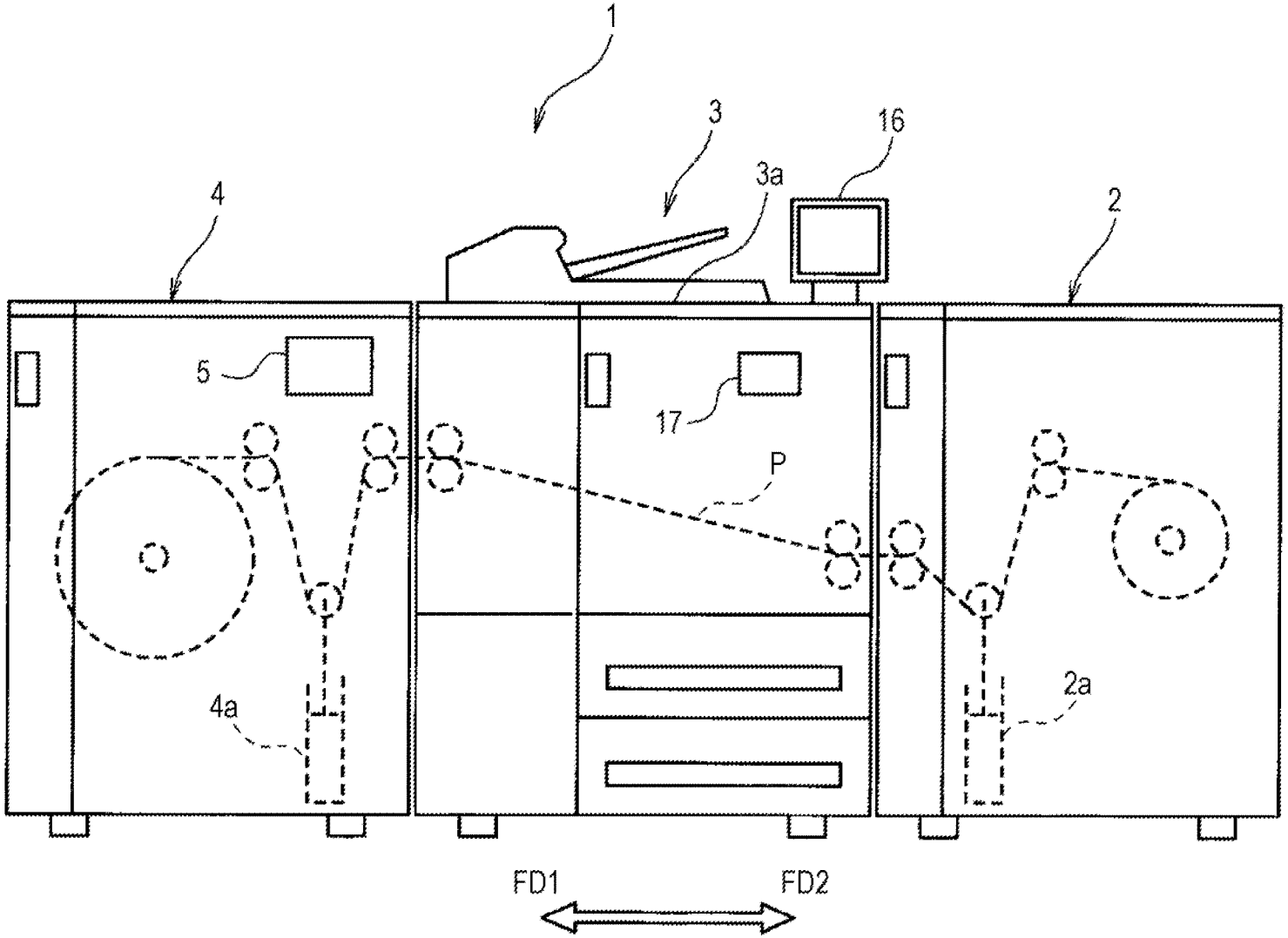
FIG. 1 is an explanatory diagram schematically illustrating the configuration of an image forming system according to an embodiment.

FIG. 1 is an explanatory diagram schematically illustrating the configuration of an image forming system 1 according to an embodiment. The image forming system 1 is mainly constituted by a paper feeding apparatus 2, an image forming apparatus 3, a winding apparatus 4 and a system controller 5. The paper feeding apparatus 2, the image forming apparatus 3, and the winding apparatus 4 are arranged in a conveying forward direction FD1 of continuous paper P in the order of the paper feeding apparatus 2, the image forming apparatus 3, and the winding apparatus 4. Besides these apparatuses, the image forming system 1 may have a configuration additionally including, for example, a paper processing apparatus that performs a predetermined process on the continuous paper P on which an image is formed. In the following description, unless otherwise mentioned, the terms "upstream" and "downstream" are used with the conveying forward direction FD1 as a reference.

The paper feeding apparatus 2 accommodates the continuous paper P and feeds the continuous paper P to the downstream apparatus in accordance with an instruction from the system controller 5. Note that the continuous paper P is, for example, roll paper but may be form paper or the like. Besides paper, the continuous paper P includes those made of resin or the like. The paper feeding apparatus 2 is provided with a tension applier 2*a* that imparts a biasing force to the continuous paper P such that a constant tension is applied to the continuous paper P within the image is apparatus 3.

Figure 2:
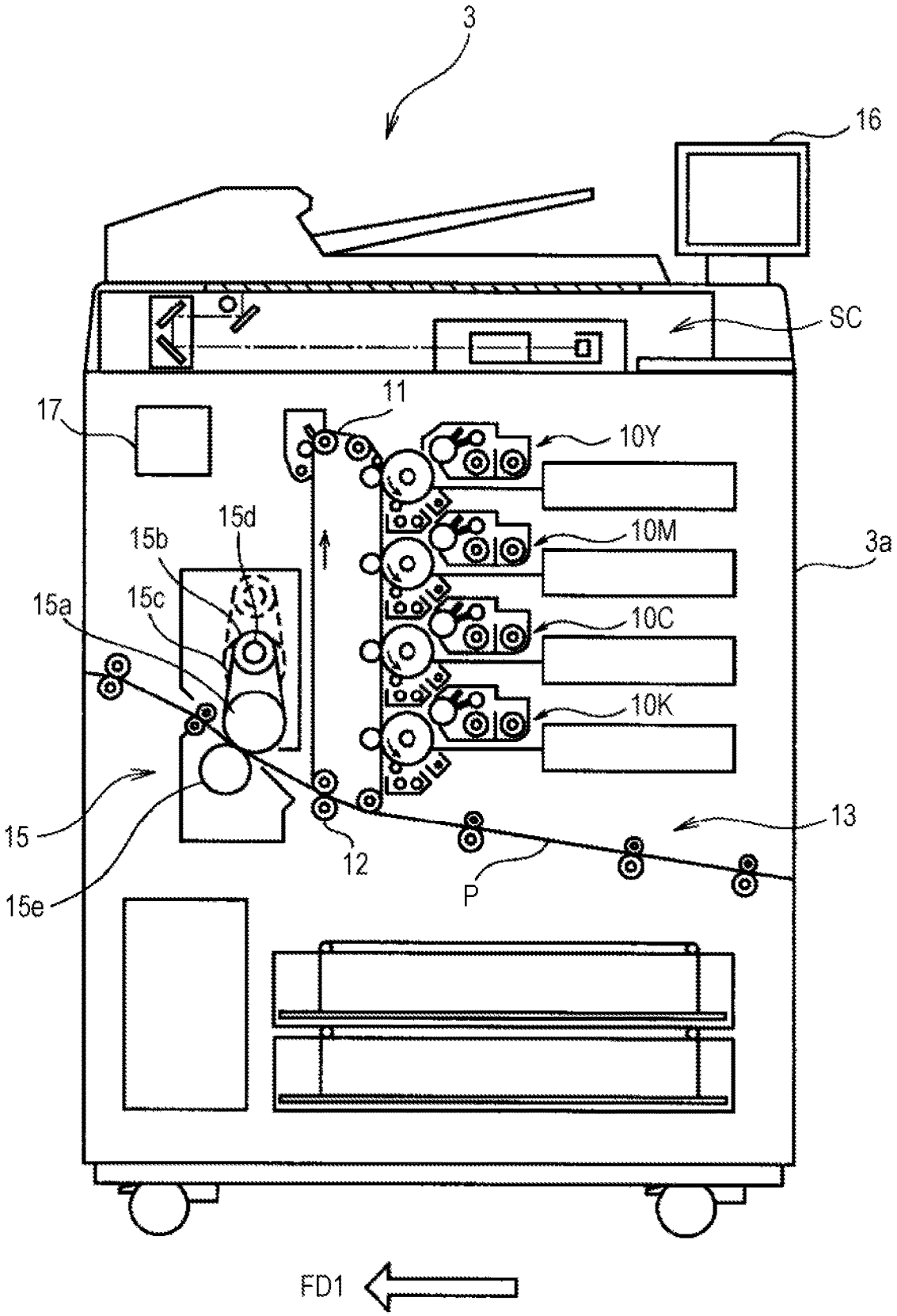
FIG. 2 is an explanatory diagram schematically illustrating the configuration of an image forming apparatus.

FIG. 2 is an explanatory diagram schematically illustrating the configuration of the image forming apparatus 3. The image forming apparatus 3 forms an image on the continuous paper P and outputs the continuous paper P on which the image is formed to the downstream side apparatus. In the present embodiment, the image forming apparatus 3 is an apparatus using an electrophotographic process and is mainly constituted by a document reading device SC, image formers 10Y, 10M, 10C, and 10K, a conveyer 13, a fixing device 15, an operation display member 16, and a control member 17.

The document reading device SC illuminates the image of a document with an illumination device and reads reflected light therefrom with a line image sensor to obtain an image signal. This image signal is subjected to processes such a analog-to-digital (A/D) conversion, shading correction, and compression and then input to the control member 17 as image data.

The image formers 10Y, 10M, 10C, and 10K are constituted by the image former 10Y that forms an image of yellow (Y), the image former 10M that forms an image of magenta (M), the image former 10C that forms an image of cyan (C), and the image former 10K that forms an image of black (K).

The image former 10Y is constituted by a photosensitive drum, and a charger, an optical writer, a developing device, and a drum cleaner arranged in the periphery of the photosensitive drum. In the image former 10Y, an image (toner image) corresponding to yellow is formed on the photosensitive drum and the image formed on the photosensitive drum is transferred by a primary transfer roller to a predetermined position on an intermediate transfer belt 11 which is an endless belt. The remaining image formers 10M, 10C, and 10K are also each constituted by a photosensitive drum, and a charger, an optical writer, a developing device, and a drum cleaner arranged in the periphery of the photosensitive drum and details thereof are similar to the image former 10Y.

The images of the respective colors transferred onto the intermediate transfer belt 11 are transferred onto the continuous paper P conveyed by the conveyer 13 by a secondary transfer roller 12 forming a transfer nip with respect to the intermediate transfer belt 11. In the present embodiment, the image formers 10Y, 10M, 10C, and 10K, the intermediate transfer belt 11, and the secondary transfer roller 12 function as a transferer (image creator) that transfers (outputs) a toner image (image) onto the continuous paper P. Note that the transferer may directly transfer an image onto the continuous paper P without using the intermediate transfer belt 11.

The conveyer 13 is made up of a plurality of conveying rollers and conveys the continuous paper P along a conveying path. The conveyer 13 conveys the continuous paper P supplied from the paper feeding apparatus 2 with the plurality of conveying rollers arranged along the conveying path and thereafter ejects the continuous paper P to the winding apparatus 4.

The fixing device 15 is a device that fixes the transferred image on the continuous paper P. The fixing device 15 is constituted by a pair of fixing members and these fixing members are pressed against each other to form a fixing nip.

One of the fixing members is arranged on the side of a fixing target surface of the continuous paper P, that is, a side opposing a surface onto which the toner image has been transferred, and in the present embodiment, is arranged above the continuous paper P. The one of the fixing members is constituted by a pressure roller 15*a*, a fixing upper roller 15*b*, and an endless fixing belt 15*c*. The pressure roller 15*a* and the fixing upper roller 15*b* are arranged to be separated from each other by a predetermined distance and the fixing belt 15*c* is stretched between these rollers 15*a* and 15*b*. A heater 15*d* is provided inside the fixing upper roller 15*b*.

The other fixing member is arranged on a side opposing the back side of the fixing target surface of the continuous paper P and in the present embodiment, is arranged below the continuous paper P being conveyed. The other fixing member is constituted by a fixing lower roller 15*e*. The fixing lower roller 15*e* is arranged so as to be pushed against the pressure roller 15*a* with the fixing belt 15*c* interposed. With this arrangement, a fixing nip is farmed between the fixing belt 15*c* and the fixing lower roller 15*e*.

In addition, the one of the fixing members can be moved in a direction in which the relative distance to the other fixing member is increased, by being driven by a driving mechanism (not illustrated). With this configuration, the fixing belt 15*c* and the fixing lower roller 15*e* can be switched from a pressed state (nip state) to a separated state (nip release state).

The operation display member 16 is an operation member that accepts an input according to a user's operation and includes, for example, a display, a touch panel capable of inputting information in accordance with information displayed on the display, and various types of switches and buttons. The information on an operation made on the operation display member 16 is input to the control member 17 or the system controller 5. By operating the operation display member 16, the user can issue a print job and make various settings. In addition, the operation display member 16 also functions as a display member that displays various items of information to the user, by being controlled by the control member 17.

The control member 17 has a function of controlling the image forming apparatus 3. The control member 17 is communicably connected to the paper feeding apparatus 2, the winding apparatus 4, and the system controller 5 and can work in cooperation with the paper feeding apparatus 2 and the winding apparatus 4.

As the control member 17, a microcomputer mainly constituted by a central processing unit (CPU), a read only memory (ROM), a random access memory (RAM), and an input/output (I/O) interface can be used. The CPU is based on an operating system (OS) and executes various types of programs and the like thereon. A program for activating the image forming apparatus 3 is stored in the ROM and the CPU activates the image forming apparatus 3 in accordance with this program. Thereafter, the CPU loads a program stored in a hard disk device (not illustrated) or the like into the RAM and executes various types of processes in accordance with the loaded program, to implement various functions included in the image forming apparatus 3 (processor).

The winding apparatus 4 winds up the continuous paper P discharged from the upstream side apparatus in accordance with an instruction from the system controller 5. The winding apparatus 4 is provided with a tension applier 4*a* that imparts a biasing force to the continuous paper P such that a constant tension is applied to the continuous paper P within the image forming apparatus 3.

The system controller 5 has a function of comprehensively controlling each apparatus constituting the image forming system 1. The system controller 5 performs necessary control on the paper feeding apparatus 2, the image forming apparatus 3, and the winding apparatus 4 such that these apparatuses work in coordination with each other.

In the image forming system 1 having such a configuration, the control member 17 of the image forming apparatus 3 controls the printing action of forming an image on the continuous paper P conveyed in the conveying forward direction FD1 by the conveyer 13. Then, when finding out that an interruption event has occurred, the control member 17 interrupts the printing action.

When interrupting the printing action, the control member 17 performs withdrawal control in which the continuous paper P is conveyed in a reverse direction such that a final image If formed on the continuous paper P before the interruption of the printing action reaches a withdrawal position Pe defined upstream of the fixing device 15 in the conveying forward direction FD1. Then, after performing the withdrawal control, the control member 17 performs reciprocating conveyance control in which the continuous paper P is conveyed alternately along the conveying forward direction FD1 and a conveying reverse direction FD2 until the interruption of the printing action is terminated.

Figure 3:
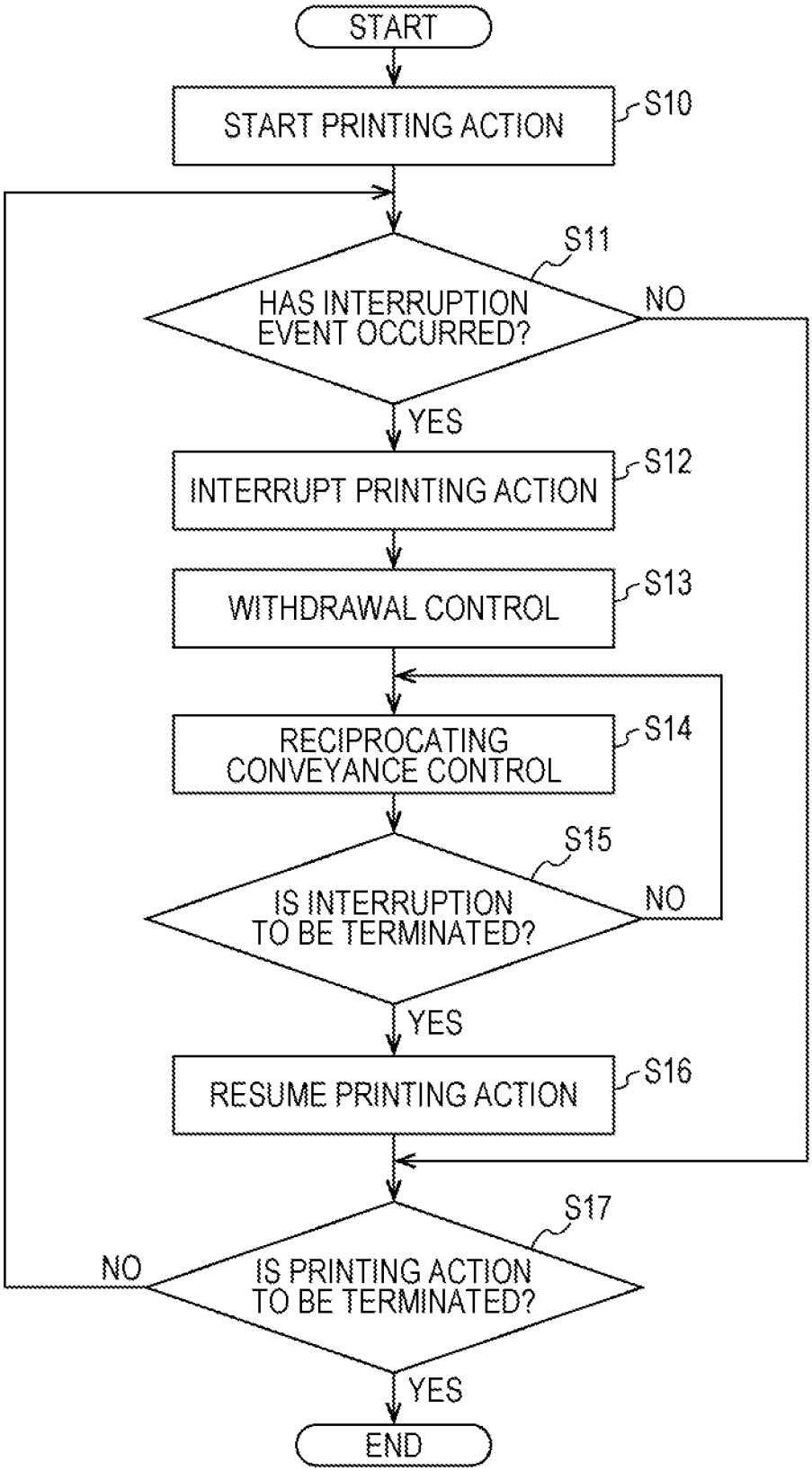
FIG. 3 is a flowchart illustrating a control method for the image forming apparatus.

Hereinafter, a control method for the image forming apparatus 3, which is one of features of the present embodiment, will be described. Here, FIG. 3 is a flowchart illustrating the control method for the image forming apparatus 3. The process illustrated in this flowchart is executed by the control member 17 of the image forming apparatus 3. In addition, FIGS. 4A to 4E and FIGS. 5A to 5C, are explanatory diagrams illustrating conveyance states of the continuous paper P.

First, in step 10 (S10), the control member 17 starts the printing action. This printing action is carried out in synchronization with the paper feeding apparatus 2 and the winding apparatus 4 while receiving instructions from the system controller 5 such that the continuous paper P is properly conveyed. Through this printing action, the image forming apparatus 3 forms a predetermined image on the continuous paper P at a constant pitch.

In step 11 (S11), the control member 17 finds out whether or not an interruption event has occurred. Here, the interruption event refers to various events that need to interrupt the printing action and events such as out of toner, full of waste toner, and carrying out image correction belong to the interruption event. Besides these events, an interruption command notified from the system controller 5 due to the paper feeding apparatus 2 or the winding apparatus 4 belongs to the interruption event.

When an interruption event has occurred, an affirmative determination is made in step 11 and the process proceeds to step 12 (S12). On the other hand, when no interruption event has occurred, a negative determination is made in step 11 and the process proceeds to step 17 (S17).

In step 12, the control member 17 interrupts the printing action. In this case, the control member 17 firstly causes the continuous paper P to be conveyed in the conveying forward direction FD1 until the transferred final image If reaches downstream of the fixing device 15 and then interrupts the printing action (refer to FIG. 4A). Furthermore, in response to the interruption of the printing action, the control member 17 switches the fixing belt 15*c* and the fixing lower roller 15*e* from the pressed state to the separated state.

In step 13 (S13), the control member 17 performs the withdrawal control. This withdrawal control is a control for causing the continuous paper P to be conveyed in the conveying reverse direction FD2 such that the final image If reaches the withdrawal position Pe defined upstream of the fixing device 15 (refer to FIG. 4B). This withdrawal control is performed in order to withdraw a blank area Re such that the blank area Re on the upstream side of the final image If is not influenced by heat from the fixing device 15 during the execution of the reciprocating conveyance control described later.

Since the fixing device 15 is accommodated in a casing 3*a* of the image forming apparatus 3, the outside of the casing 3*a* is less influenced by heat from the fixing device 15. For this reason, in the present embodiment, the withdrawal position Pe is defined upstream of the casing 3*a* of the image forming apparatus 3. When the withdrawal position Pe is shifted away from the image forming apparatus 3, the distance by which the continuous paper P is re-conveyed at the time of resuming the printing action becomes longer. Therefore, it is preferable that the withdrawal position Pe be defined at a position in the vicinity of the casing 3*a* within a range upstream of the casing 3*a* (distance C=0 described later). Accordingly, a conveyance amount L of the continuous paper P to be conveyed in the conveying reverse direction FD2 during this withdrawal control is given as a sum of a distance A from the position of the final image If at the time of interrupting the printing action to the fixing device 15, a distance 13 by which the continuous paper P is conveyed within the casing 3*a*, and a distance C from the most upstream position of the casing 3*a* to the withdrawal position Pe.

In step 14 (S14), the control member 17 performs the reciprocating conveyance control in which the continuous paper P is conveyed alternately along the conveying forward direction FD1 and the conveying reverse direction FD2. In this case, the control member 17 performs the reciprocating conveyance control within a range where the blank area Re is present upstream of the withdrawal position Pe. In the present embodiment, at the start of the reciprocating conveyance control, an end portion of the blank area Re is present immediately above the casing 3*a*. Therefore, when performing the reciprocating conveyance control, the control member 17 starts conveying the continuous paper P from the conveying reverse direction FD2 (refer to FIG. 4C). Thereafter, once the continuous paper P is conveyed by a predetermined distance in the conveying reverse direction FD2, the control member 17 reverses the conveying direction and convoys the continuous paper P in the conveying Forward direction FD1 (refer to FIG. 4D). In the reciprocating conveyance control, such a reciprocating action of the continuous paper P is repeated until the interruption of the printing action is terminated.

It is also possible to start conveying the continuous paper P from the conveying Forward direction FD1 when performing the reciprocating conveyance control. In this case, the conveyance amount L of the continuous paper P during the withdrawal control is set in consideration of the conveyance mode of the continuous paper P in the conveying forward direction FD1 during the reciprocating conveyance control (refer to FIG. 5A). Specifically, this conveyance amount L is given as a value obtained by adding a distance D conveyed in the conveying forward direction FD1 during the reciprocating conveyance control, in addition to the above-described distance A, distance B, and distance C.

Figure 5A:
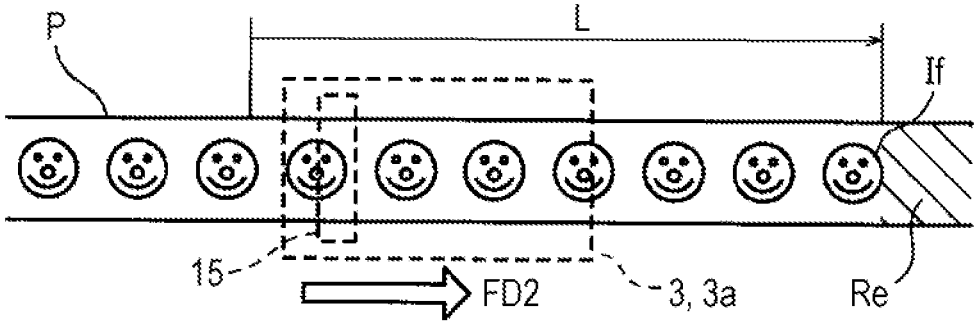
FIGS. 5A to 5C are explanatory diagrams illustrating conveyance states of continuous paper.
Figure 5B:
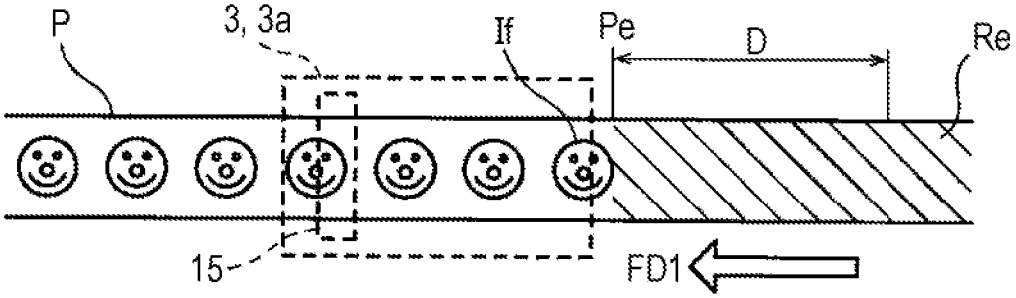
Figure 5C:
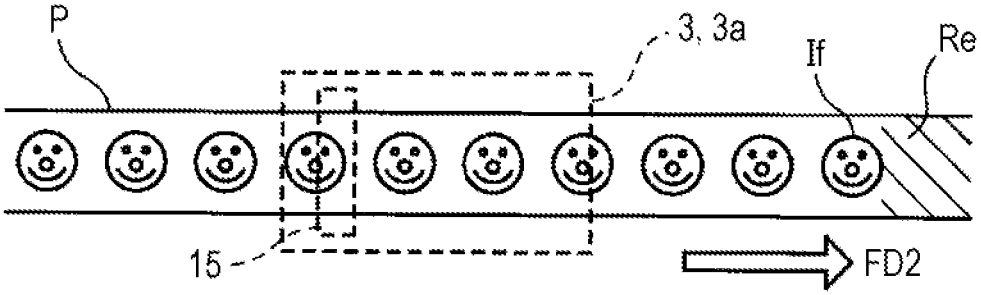
Figure 6A:
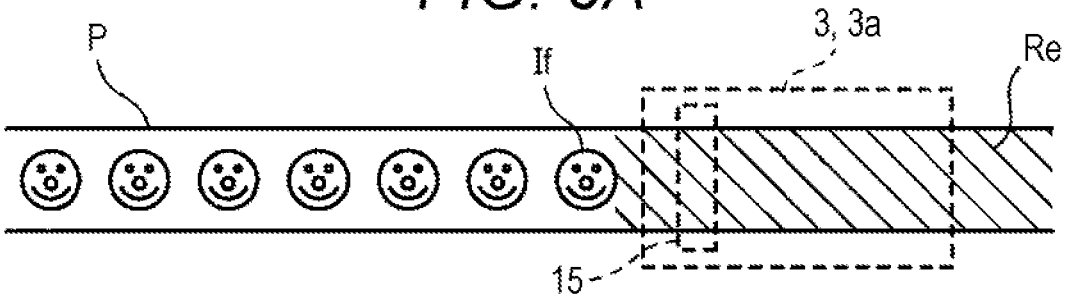
FIGS. 6A to 6D are explanatory diagrams illustrating the state of continuous paper in a case where withdrawal control is not applied.
Figure 6B:
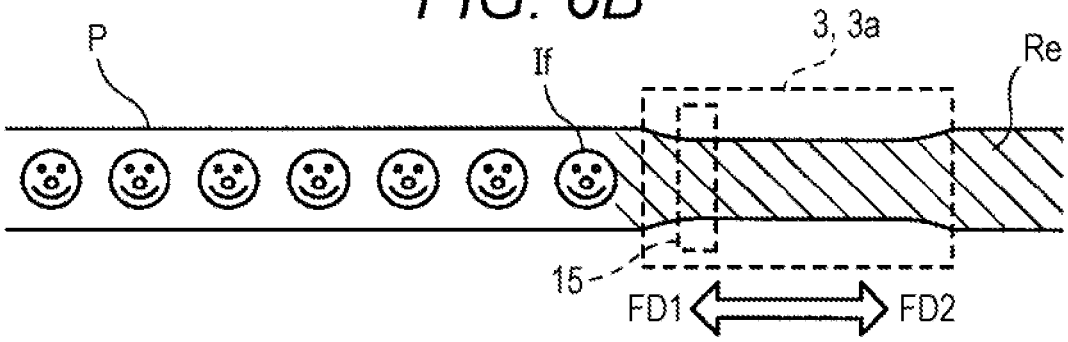
Figure 6C:
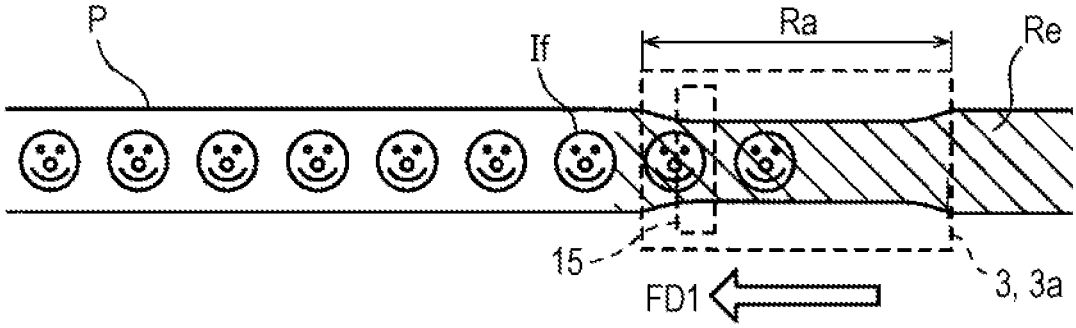
Figure 6D:
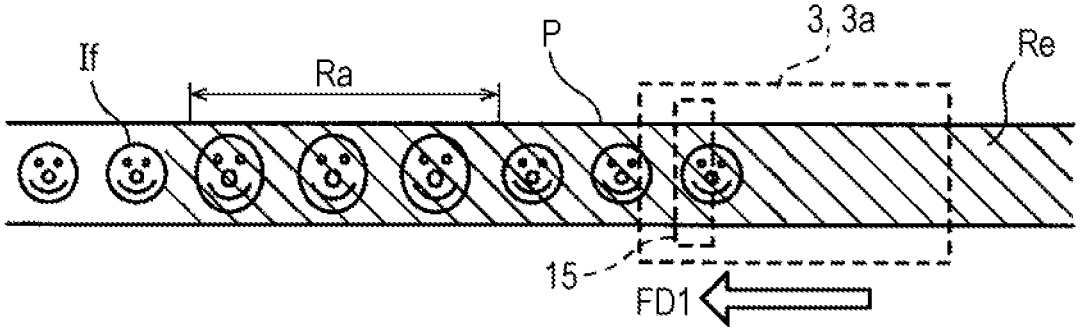

In this case, the control member 17 starts conveying the continuous paper P from the conveying forward direction FD1 (refer to FIG. 5B). Thereafter, once the continuous paper P is conveyed by the distance D in the conveying forward direction FD1, the control member 17 reverses the conveying direction and conveys the continuous paper P in the conveying reverse direction FD2 (refer to FIG. 5C). In the reciprocating conveyance control, such a reciprocating action of the continuous paper P is repeated until the interruption of the printing action is terminated. With this configuration, it is possible to perform the reciprocating conveyance control within a range where the blank area Re is present upstream of the withdrawal position Pe even if the conveyance of the continuous paper P is started from the conveying forward direction FD1 alter the withdrawal control is performed.

In step 15 (S15), the control member 17 finds out whether or not to terminate the interruption of the printing action. When the interruption event has been resolved, an affirmative determination is made in step 15 and the process proceeds to step 16 (S16). On the other hand, when the interruption event has not been resolved, a negative determination is made in step 15 and the process returns to step 14.

In step 16, the control member 17 causes the continuous paper P to be conveyed in the conveying forward direction FD1 and resumes the printing action from the blank area Re. Furthermore, in response to the resume of the printing action, the control member 17 switches the fixing belt 15*c* and the fixing lower roller 15*e* from the separated state to the pressed state.

Figure 4A:
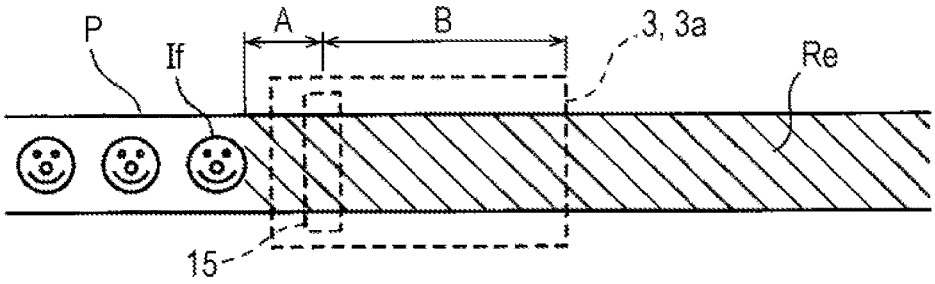
FIGS. 4A to 4E are explanatory diagrams illustrating conveyance states of continuous paper.
Figure 4B:
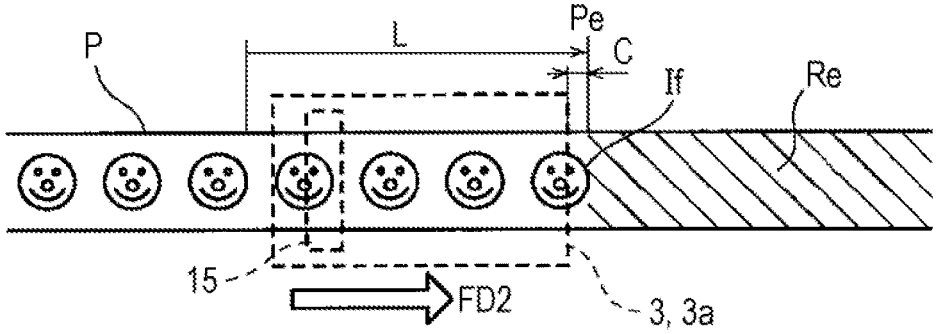
Figure 4C:
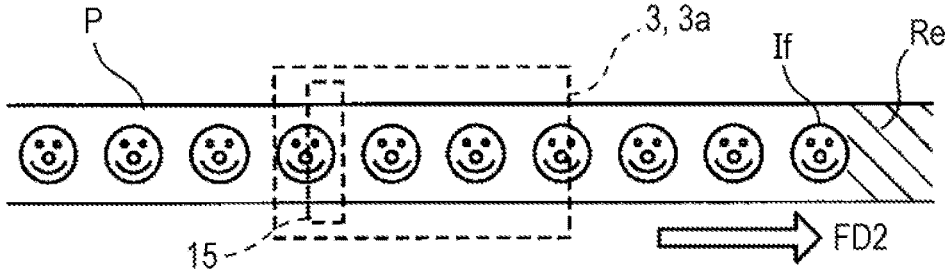
Figure 4D:
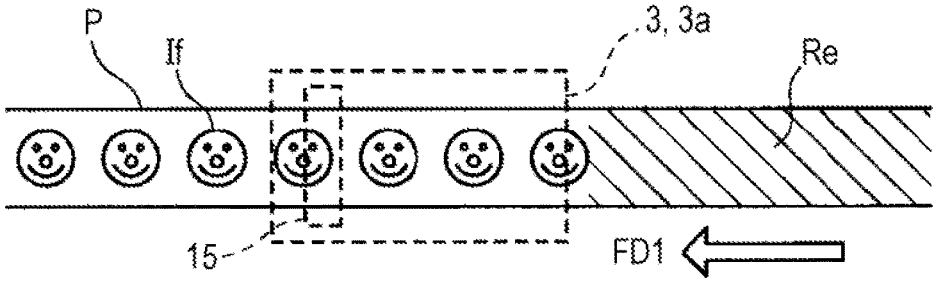
Figure 4E:
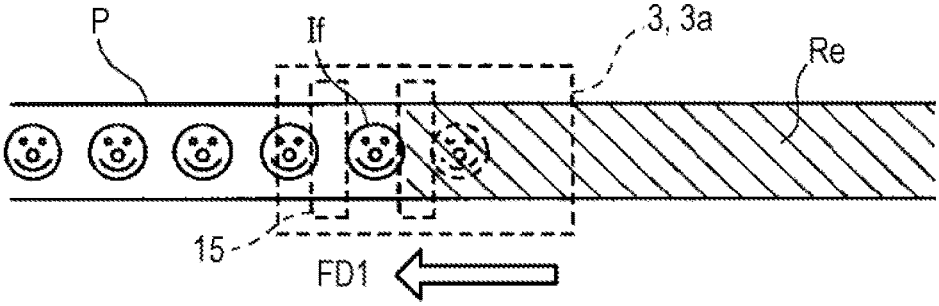

Upon resuming the printing action, the control member 17 forms an image after the start of the printing action using the position of the final image If as a reference (refer to FIG. 4E). Normally, when an image is formed on the continuous paper P, a patch for recognizing the image position is simultaneously formed in order to perform various types of processes on the continuous paper P on which the image is printed. This patch is read by a reader arranged at a reference position on the conveying path on the upstream side of the image forming apparatus 3 and information thereon is input to the system controller 5. When finding out that the patch attached to the final image If has passed through the reference position on the basis of the information from the reader, the system controller 5 outputs passing information on the patch to the control member 17. On the basis of the distance to the reference position and the conveying speed of the continuous paper P, the control member 17 forms a first image after resumption so as to maintain a predetermined pitch with respect to the final image If.

In step 17, the control member 17 finds out whether or not to terminate the printing action. When the printing action is to be terminated, an affirmative determination is made in step 17 and this routine is terminated (END). On the other hand, when the printing action is to be continued, a negative determination is made in step 17 and the process returns to step 11.

As described above, according to the image forming apparatus 3 of the present embodiment, when the printing action is interrupted, the withdrawal control is performed to convey the continuous paper P in the reverse direction such that the final image If formed on the continuous paper P before the interruption of the printing action reaches the withdrawal position Pe defined upstream of the fixing device 15.

Here, FIGS. 6A to 6D are explanatory diagrams illustrating the state of the continuous paper P in a case where the withdrawal control is not applied. As in the above-described embodiment, when the priming action is interrupted, the continuous paper P is firstly convoyed in the conveying forward direction FD1 until the final image If reaches downstream of the fixing device 15 and then the printing action is interrupted (refer to FIG. 6A).

In a case where the withdrawal control indicated in the present embodiment is not performed, the reciprocating conveyance control is performed after the interruption of the printing action. Incidentally, depending on the stop position of the continuous paper P at the time of interruption or the initial conveying direction of the reciprocating conveyance control, the reciprocating conveyance control is performed in such a state that the blank area Re straddles the fixing device 15 (refer to FIG. 6B). In this case, moisture is released from the continuous paper P by receiving the heat of the fixing device 15 and as a consequence, a partial area Ra of the continuous paper P (blank area Re) is reduced in size.

Meanwhile, once the interruption of the printing action is terminated, the continuous paper P is conveyed in the conveying forward direction FD1 and the printing action is resumed from the blank area Re. In this case, the image after the interruption is formed in the area Ra reduced in size (refer to FIG. 6C). Then, when the image formation on the continuous paper P progresses and the area Ra reduced in size is conveyed to the side of the casing 3*a* of the image forming apparatus 3, moisture is absorbed from the ambient atmosphere and the area Ra is restored to the original size (refer to FIG. 6D). Consequently, the magnification of the image alters in the area Ra.

In this regard, according to the present embodiment, since the withdrawal control is executed, the area where the image is already formed is present around the fixing device 15 during the reciprocating conveyance control. Even in the area where the image is formed, the reduction of the size occurs by receiving the heat of the fixing device 15. In this case, however, the image is also reduced in size in line with the reduction of the continuous paper P in size. Accordingly, as the printing action is resumed, the continuous paper P is conveyed to the downstream side and the continuous paper P absorbs moisture from the ambient atmosphere, such that the image is also restored to the original size together with the continuous paper P. As a consequence, it is possible to suppress a change in image magnification before and after the interruption of the printing action.

The present embodiment has described a mode in which the continuous paper P is conveyed only in the conveying reverse direction FD2 as the withdrawal control. However, as long a the final image If reaches the withdrawal position Pe as a result, an action such a conveying the continuous paper P in the conveying forward direction FD1 may be inserted in the middle of reaching the withdrawal position Pe.

Furthermore, in the present embodiment, when the interruption of the printing action is terminated, the control member 17 causes the continuous paper P to be conveyed in the conveying forward direction FD1 to resume the printing action from the blank area Re. With this configuration, it is possible to shorten the image interval before and after the interruption of the printing action, whereby a wasteful area occurring in the continuous paper P can be suppressed.

Additionally, in the present embodiment, the control member 17 firstly performs the withdrawal control and then performs the reciprocating conveyance control until the interruption of the printing action is terminated. In this case, the control member 17 performs the reciprocating conveyance control within a range where the blank area Re is present upstream of the withdrawal position Pe. According to this configuration, since the blank area Re is withdrawn from the fixing device 15 while the printing action is interrupted, heat influence on the blank area Re can be suppressed.

Meanwhile, in the present embodiment, when interrupting the printing action, the control member 17 causes the continuous paper P to be conveyed in the conveying forward direction FD1 until the final image If reaches downstream of the fixing device 15 and, after this conveyance is finished, performs the withdrawal control. With this configuration, it is possible to suppress a situation in which the printing action is interrupted while an image is left unfixed.

Furthermore, in the present embodiment, the withdrawal position Pe is defined upstream of the casing 3*a* of the image forming apparatus 3 on the conveying path of the continuous paper P. According to this configuration, the blank area Re is withdrawn to the outside of the casing 3*a* of the image forming apparatus 3 by the withdrawal control. Consequently, heat influence on the blank area Re can be suppressed.

Since the image formers 10Y, 10M, 10C, and 10K, the intermediate transfer belt 11, the secondary transfer roller 12, and the like, which serve as the transferer, are present, the upstream side of the transferer tends to be less influenced by heat from the fixing device 15 even in the inside of the casing 3*a*. For this reason, the withdrawal position Pe may be defined upstream of the transferer on the conveying path of the continuous paper P.

Additionally, in the present embodiment, the tension appliers 2*a* and 4*a* that apply tension to the continuous paper P are provided upstream and downstream of the casing 3*a* of the image forming apparatus 3, respectively. With this configuration, in the image forming apparatus 3, the continuous paper P can be properly conveyed in both of the conveying forward direction FD1 and the conveying reverse direction FD2.

In the present embodiment, the tension appliers 2*a* and 4*a* are provided in the paper feeding apparatus 2 and the winding apparatus 4, but the tension appliers 2*a* and 4*a* may be included in the image forming apparatus 3.

Furthermore, in the present embodiment, the control member 17 forms an image after the start of the printing action using the position of the final image If as a reference. According to this configuration, it is possible to maintain the same image interval before and after the interruption of the printing action. As a consequence, it is possible to suppress the influence on the image formation due to the interruption of the printing action.

The present embodiment has described the image forming apparatus 3 that uses the electrophotographic process and includes the transferer that transfers the image onto the continuous paper P and the fixing device 15 that imparts heat to the continuous paper P. However, the image Forming apparatus 3 according to the present embodiment can be widely applied to a configuration including an image creator that outputs an image onto the continuous paper P and a heat source that imparts heat to the continuous paper P. For example, a configuration including an image creator that outputs ultraviolet curing ink or ultraviolet curing varnish and a heat source that imparts ultraviolet ray, or a configuration including an image creator that outputs aqueous ink and a heat source that imparts heat for drying (inkjet technique) may be adopted.

Additionally, the present embodiment has given the description on the premise that the reciprocating conveyance control is performed during the interruption period of the printing action. However, it is not always necessary to execute the reciprocating conveyance control. For example, when there is a sufficient amount of the continuous paper P wound up on the winding apparatus 4, a configuration may be adopted in which the blank area Re is conveyed by a predetermined distance (at least a distance by which the final image If reaches the withdrawal position Pe) in the conveying reverse direction FD2 such that the conveying direction is inverted only once before resuming the printing action.

Although the image forming apparatus and the image forming system according to the embodiments of the present invention have been described and illustrated in detail, the disclosed embodiments are made for purposes of illustration and example only and not limitation. The scope of the present invention should be interpreted by terms of the appended claims. Furthermore, the image forming system, the control method for the image forming apparatus, and a program itself that causes a computer to execute this control method also function as a part of the present invention. An information recording medium in which this program is stored also functions as a part of the present invention.

What is claimed is:

1. An image forming apparatus comprising:

a conveyer that conveys continuous paper;

an image creator that outputs an image onto the continuous paper, a heat source that imparts heat to the continuous paper; and a hardware processor that controls a printing action for forming an image on the continuous paper conveyed in a forward direction by the conveyer, using the image creator and the heat source, wherein when interrupting the printing action, the hardware processor performs withdrawal control in which the continuous paper is conveyed in a reverse direction such that a final image formed on the continuous paper before interruption of the printing action reaches a withdrawal position defined upstream of one of the image creator and the image forming apparatus in the forward direction.

2. The image forming apparatus according to claim 1, wherein when the interruption of the printing action is terminated, the hardware processor causes the continuous paper to be conveyed in the forward direction and resumes the printing action from an area of the continuous paper on an upstream side of the final image in the forward direction.

3. The image forming apparatus according to claim 1, wherein the hardware processor firstly performs the withdrawal control and then performs reciprocating conveyance control in which the continuous paper is conveyed alternately along the forward direction and the reverse direction until the interruption of the printing action is terminated, and the reciprocating conveyance control is performed within a range where an area of the continuous paper on the upstream side of the final image in the forward direction is present upstream of the withdrawal position in the forward direction.

4. The image forming apparatus according to claim 1, wherein, when interrupting the printing action, the hardware processor causes the continuous paper to be conveyed in the forward direction until the final image reaches downstream of the heat source in the forward direction and performs the withdrawal control after the above-mentioned conveyance is finished.

5. The image forming apparatus according to claim 1, further comprising tension appliers that are separately provided upstream and downstream of a casing of the image forming apparatus in the forward direction and apply tension to the continuous paper.

6. The image forming apparatus according to claim 1, wherein the hardware processor forms an image after start of the printing action using a position of the final image as a reference.

7. The image forming apparatus according to claim 1, wherein the image creator transfers a toner image onto the continuous paper, the heat source fixes the toner image transferred by the image creator and is constituted by a pair of fixing members switchable between a pressed state and a separated state, and when interrupting the printing action, the hardware processor switches the pair of fixing members from the pressed state to the separated state.

8. An image forming system comprising:

a paper feeding apparatus that supplies continuous paper;

the image forming apparatus according to claim 1, which forms an image on the continuous paper fed from the paper feeding apparatus; and a winding apparatus that winds up the continuous paper discharged from the image forming apparatus.

9. A control method for an image forming apparatus that performs a printing action for forming an image on continuous paper conveyed in a forward direction, using an image creator that outputs an image onto the continuous paper and a heat source that imparts heat to the continuous paper, the control method comprising:

interrupting the printing action on condition that an interruption event has occurred; and performing withdrawal control in which the continuous paper is conveyed in a reverse direction such that a final image formed on the continuous paper before interruption of the printing action reaches a withdrawal position defined upstream of one of the image creator and the image forming apparatus in the forward direction.

10. The control method for the image forming apparatus according to claim 9, further comprising on condition that the interruption of the printing action is terminated, causing the continuous paper to be conveyed in the forward direction and resuming the printing action from an area of the continuous paper on an upstream side of the final image in the forward direction.

11. The control method for the image forming apparatus according to claim 10, wherein the causing the continuous paper to be conveyed in the forward direction and resuming the printing action forms an image after start of the printing action using a position of the final image as a reference.

12. The control method for the image forming apparatus according to claim 9, further comprising after the performing withdrawal control, performing reciprocating conveyance control in which the continuous paper is conveyed alternately along the forward direction and the reverse direction until the interruption of the printing action is terminated, wherein the reciprocating conveyance control is performed within a range where an area of the continuous paper on the upstream side of the final image in the forward direction is present upstream of the withdrawal position in the forward direction.

13. The control method for the image forming apparatus according to claim 9, wherein the interrupting the printing action includes a process of conveying the continuous paper in the forward direction until the final image reaches downstream of the heat source in the forward direction.

14. The control method for the image forming apparatus according to claim 9, wherein the image creator transfers a toner image onto the continuous paper, the heat source fixes the toner image transferred by the image creator and is constituted by a pair of fixing members switchable between a pressed state and a separated state, and the interrupting the printing action includes a process of switching the pair of fixing members from the pressed state to the separated state.

15. A non-transitory recording medium storing a computer readable program causing a computer to execute the control method for the image forming apparatus according to claim 9.

* * * * *